US005495866A

United States Patent [19]

Lu

[11] Patent Number: 5,495,866

[45] Date of Patent: Mar. 5, 1996

[54] UMBRELLA DRIP WATER COLLECTOR

[75] Inventor: Li-An Lu, Taipei, Taiwan

[73] Assignee: Conser Technology, Inc., Taipei, Taiwan

[21] Appl. No.: 463,284

[22] Filed: Jun. 5, 1995

[51] Int. Cl.[6] ..... A45B 25/28

[52] U.S. Cl. ..... 135/48; 135/15.1

[58] Field of Search ..... 135/15.1, 16, 33.6, 135/48, 44

[56] References Cited

U.S. PATENT DOCUMENTS

| | | | |
|---|---|---|---|
| 559,101 | 4/1896 | Hindes | 135/48 |
| 4,703,768 | 11/1987 | Lee | 135/48 |
| 5,135,017 | 8/1992 | Fujiyama | 135/48 X |
| 5,161,560 | 11/1992 | Sheu | 135/48 X |

*Primary Examiner*—Lanna Mai
*Attorney, Agent, or Firm*—Bacon & Thomas

[57] ABSTRACT

An umbrella drip water collector including a receptacle, a sponge mounted within the receptacle, a hollow barrel inserted through a longitudinal center through hole on the sponge and extended out of the bottom center hole on the receptacle and having an outward top flange stopped above the sponge, a top rubber cap cap fastened to the barrel and stopped above the outward flange and defining a stepped center through hole for the insertion of the ferrule of any of a variety of umbrellas into the inside of the barrel, a bottom rubber cap fastened to the bottom end of the barrel to seal the bottom center hole of the receptacle, wherein when the receptacle is moved axially relative to the barrel, water is squeezed out of the sponge by the outward flange of the barrel.

1 Claim, 5 Drawing Sheets

UMBRELLA DRIP WATER COLLECTOR

BACKGROUND OF THE INVENTION

The present invention relates to an umbrella drip water collector for attaching to the ferrule of any of a variety of umbrellas to collect drip water, which can be conveniently operated to expel water out of the receptacle thereof.

When an umbrella is collapsed and carried by the user to the inside of an office, room, bus, etc., drip water will fall from the umbrella to damp the ground. There is known an umbrella drip water collecting device for attaching to the ferrule of the umbrella to collect drip water, which comprised of a receptacle having a plurality of water holes at the top side, a hollow shaft inside the receptacle for receiving the ferrule of the umbrella, a pressure rod with a rubber pad attached to the bottom end of the hollow shaft, a sponge mounted inside the receptacle, a spring mounted inside the pressure rod and covered by an inside cap, and a bottom cap covered on the bottom end of the receptacle around the the pressure rod. When in use, drip water falls from the umbrella through the water holes on the top side of the receptacle into the sponge inside of the receptacle, and therefore water is absorbed by the sponge. When the pressure rod is stopped against the ground and the umbrella is forced downwards, the spring is compressed, the rubber pad is moved away from the bottom opening of the receptacle, and water is squeezed out of the sponge and guided out of the bottom opening of the receptacle. When the pressure rod is released from the ground, the spring returns to its former shape, and therefore the rubber pad is moved back to its former position to seal the bottom opening of the receptacle. This structure of umbrella drip water collecting device is complicated structure. Another drawback of this structure of umbrella drip water collecting device is that it cannot fit the ferrules of different sizes. Furthermore, when the pressure rod is forced against an object by an error, water immediately flows out of the receptacle to damp the surroundings.

There is known another structure of umbrella drip water collecting device which fixedly secured to the umbrella to collect drip water from the umbrella when the umbrella is collapsed. This structure of umbrella drip water comprises a covering covered over the ferrule of the umbrella, a sponge mounted in the covering, a pressure rod movably mounted around the umbrella shaft and having a conical outward flange. When the umbrella is opened, the conical outward flange of the pressure rod is forced against the sponge inside the covering, causing water squeezed out of the sponge. This structure of umbrella drip water collecting device is functional, however it is fixed when the umbrella is made. Therefore, this structure of umbrella drip water collecting device cannot be used in regular umbrellas. Furthermore, because it is fixedly secured to the umbrella, it is difficult to repair when one part is damaged.

SUMMARY OF THE INVENTION

The present invention has been accomplished to provide an umbrella drip water collector which is suitable for use with any of a variety of umbrellas. According to the preferred embodiment of the present invention, the umbrella drip water collector comprises a receptacle, a sponge mounted within the receptacle, a hollow barrel inserted through a longitudinal center through hole on the sponge and extended out of the bottom center hole on the receptacle and having an outward top flange stopped above the sponge, a top rubber cap cap fastened to the barrel and stopped above the outward flange and defining a stepped center through hole for the insertion of the ferrule of any of a variety of umbrellas into the inside of the barrel, a bottom rubber cap fastened to the bottom end of the barrel to seal the bottom center hole of the receptacle. When to squeeze water out of the sponge, the receptacle is moved axially relative to the barrel, and the sponge is compressed by the outward flange of the barrel. Because the receptacle does not move relative to the barrel when the rubber bottom cap is forced by the umbrella against the ground, water does leak out of the receptacle when the user uses umbrella as a stick and stops it against ground.

DETAILED DESCRIPTION OF THE PREFERRED EMBODIMENT

Figure 3:
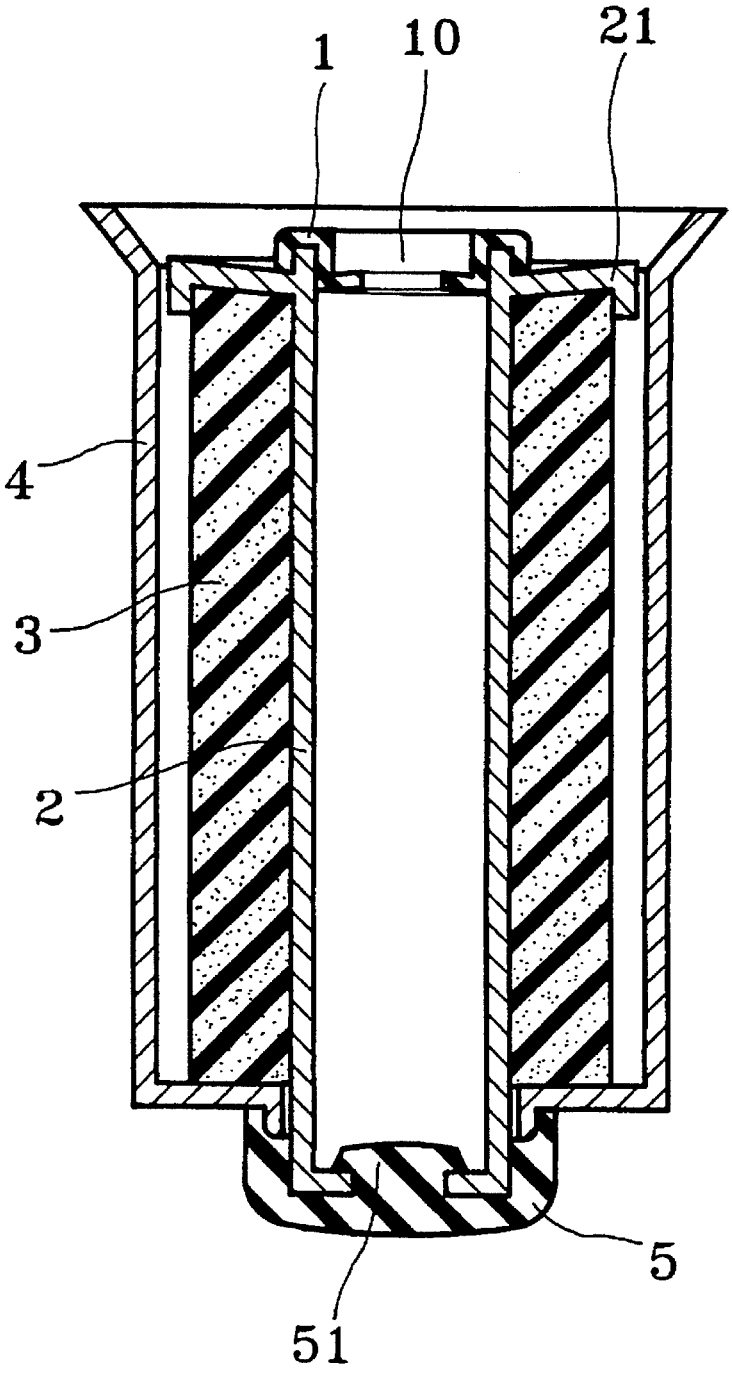
FIG. 3 is a longitudinal view in section of FIG. 1.

An umbrella drip water collector accordance with the present invention is to be attached to the ferrule of an umbrella and to collect drip water from the umbrella when the umbrella is collapsed (see FIG. 3).

Figure 1:
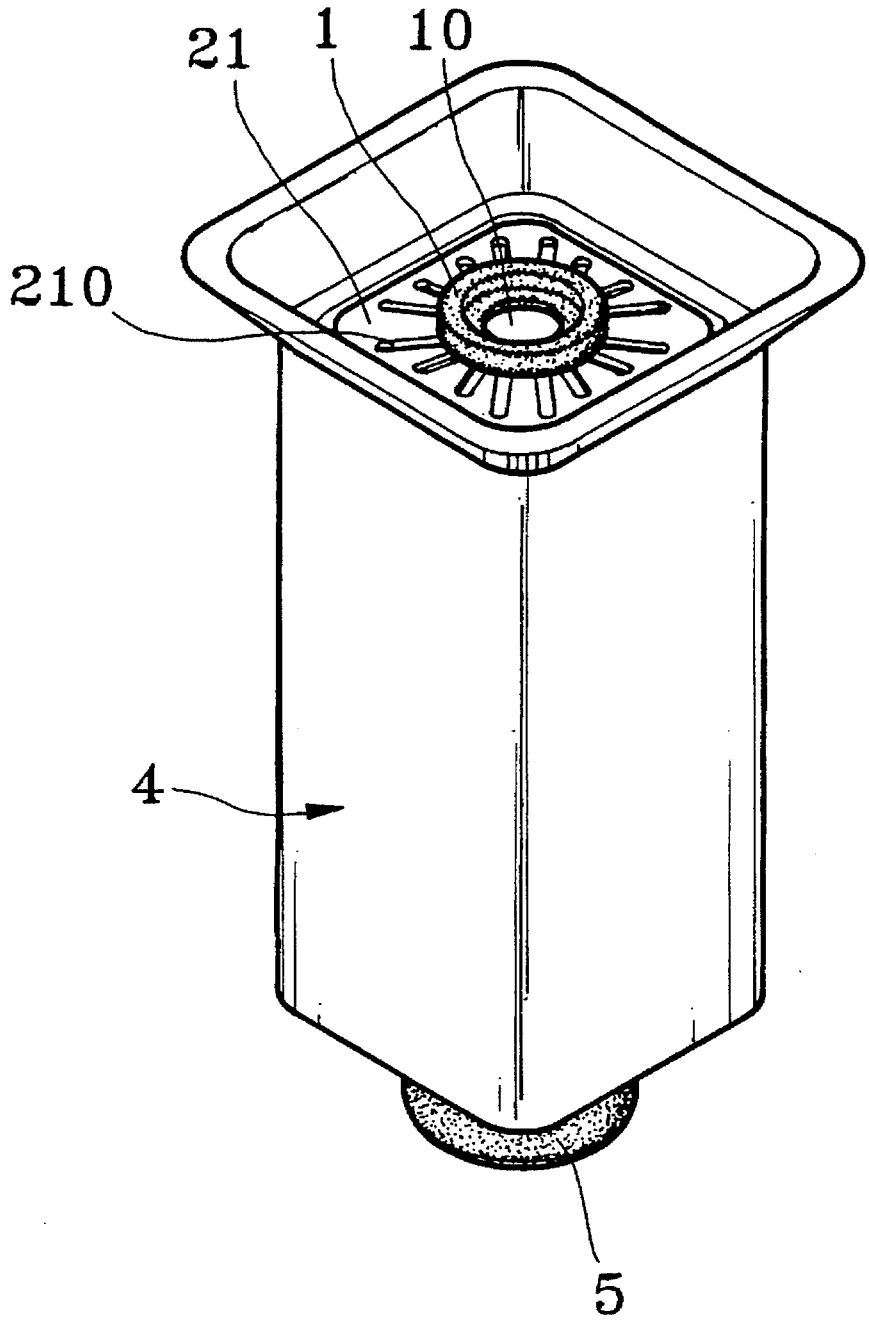
FIG. 1 is an elevational view of an umbrella drip water collector according to the present invention.
Figure 2:
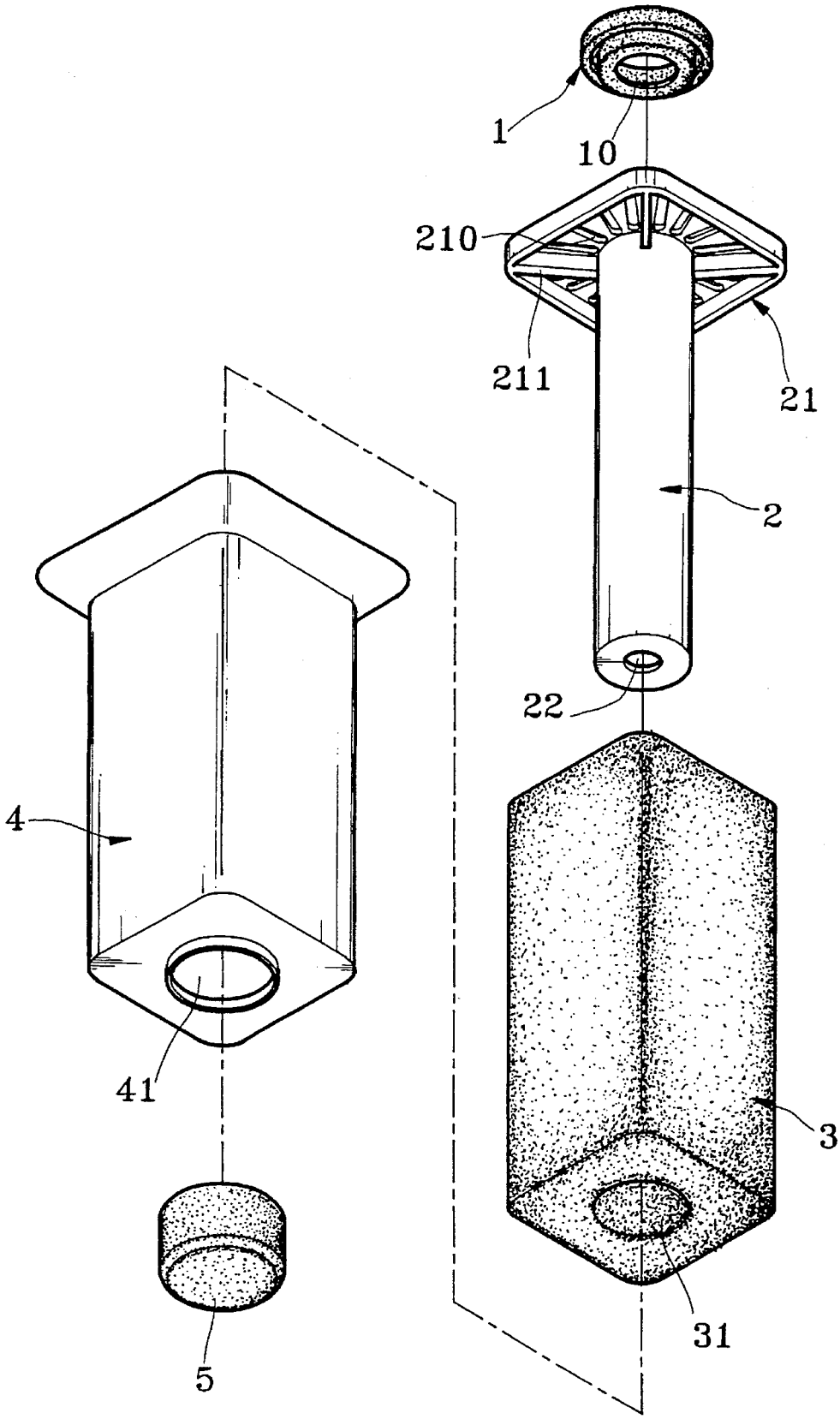
FIG. 2 is an exploded view of the umbrella drip water collector shown in FIG. 1.

Referring to FIGS. 1, 2, and 3, the umbrella drip water collector is generally comprised of a top rubber cap 1, a barrel 2, a sponge 3, a receptacle 4, and a bottom rubber cap 5. The receptacle 4 is a top-open container having a bottom hole 41 at the center. The diameter of the top open side of the receptacle 4 gradually increases toward the top so that drip water from the umbrella can be guided into the inside of the receptacle 4. The sponge 3 is inserted into the receptacle 4, having a longitudinal center through hole 31 aligned with the bottom hole 41 on the receptacle 4 for receiving the barrel 2. The barrel 2 is a hollow cylinder inserted into the longitudinal center through hole 31 on the sponge 4, having an outward flange 21 at the top fitted into the receptacle 4 and covered on the sponge 3 inside the receptacle 4, and a bottom hole 22 at the center of the bottom end thereof. The outward flange 21 of the barrel 2 has radial reinforcing ribs 211, which reinforces the structural strength of the outward flange 21, and radial slots 210, which guide drip water from the umbrella to the sponge 3 inside the receptacle 4. The top rubber cap 1 is fastened to the top open end of the barrel 22 and stopped above the outward flange 21, having a stepped center through hole 10 for receiving the ferrule of any of a variety of umbrellas. As the top rubber cap 1 is expansible, ferrules of different sizes can be alternatively inserted through the the stepped center through hole 10 of top rubber cap 1 into the inside of the barrel 2. The bottom rubber cap 5 is a closed cap fastened to the bottom end of the barrel 2 and stopped outside the bottom hole 41 of the receptacle 4, having a headed stud 51 on the inside fastened to the bottom hole 22 on the barrel 2. The diameter of the outward flange 21 of the barrel 2 is slightly smaller than the inner diameter of the receptacle 4 so that the barrel 2 can be moved longitudinally relative to the receptacle 4, and the sponge 3 can be compressed by the outward flange 21 of the barrel 2 when the barrel 2 is moved downwards relative to the receptacle 4. When assembled, as shown in FIG. 3, the bottom end of the barrel 2 protrudes out of the bottom hole 41 of the receptacle 4, and the bottom rubber cap 5 is covered over the bottom end of the barrel 2 and stopped against the outside wall of the receptacle 4 around the bottom hole 41 to seal the gap between the barrel 2 and the bottom hole 41. Therefore water does not flow out of the receptacle 4 through the bottom hole 41.

Figure 4:
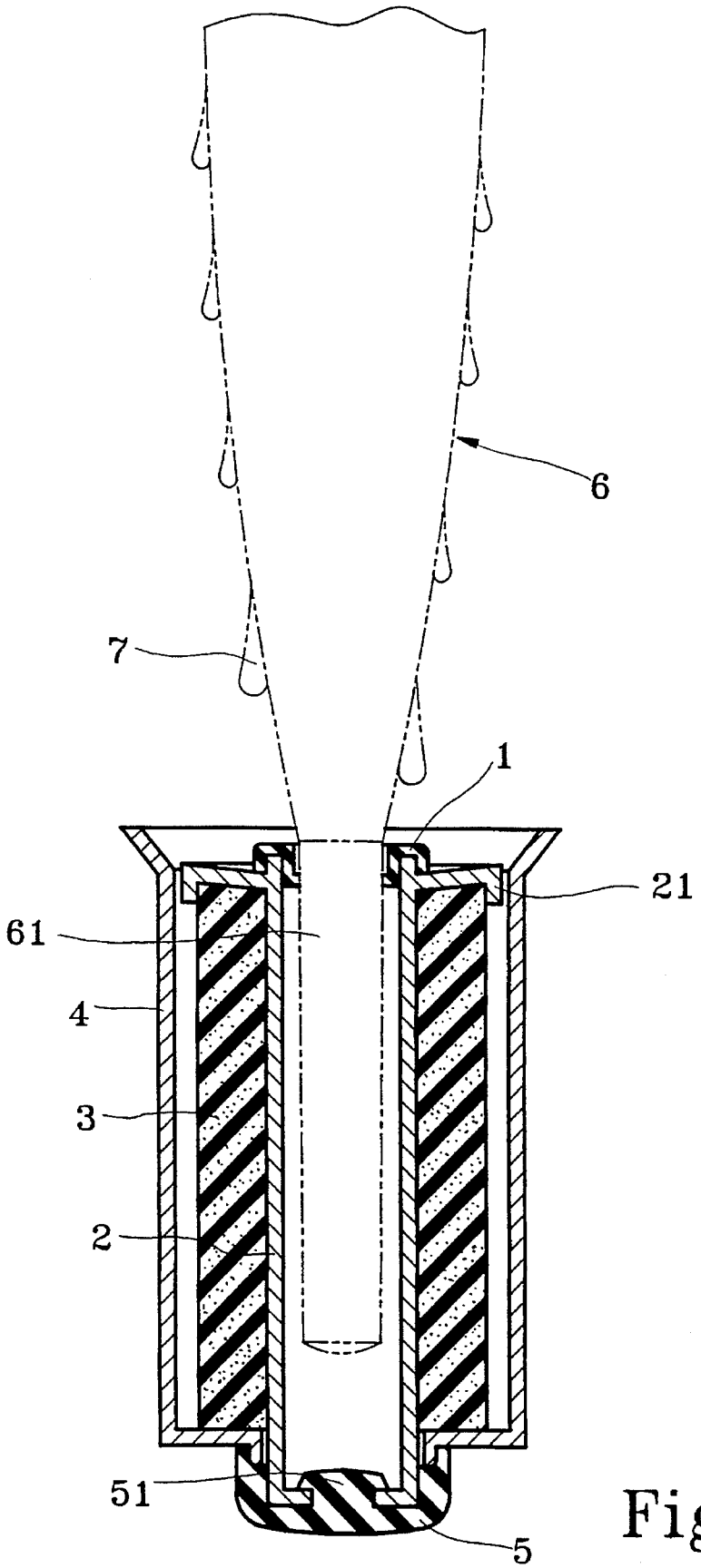
FIG. 4 is an applied view showing an umbrella inserted into the umbrella drip water collector and drip water collected in the collector according to the print invention.

Referring to FIG. 4, the ferrule 61 of the umbrella 6 is inserted into the barrel 2 and the umbrella 6 is collapsed, and drip water 7 falls from the umbrella 6 to the outward flange 21 of the barrel 2 and then flows through the radial slots 210 on the outward flange 21 of the barrel 2 into the sponge 3. Because drip water 7 from the umbrella 6 is absorbed by the sponge 3, it does not flow out of the receptacle 4 when the umbrella 6 is put in a flat surface.

Figure 5:
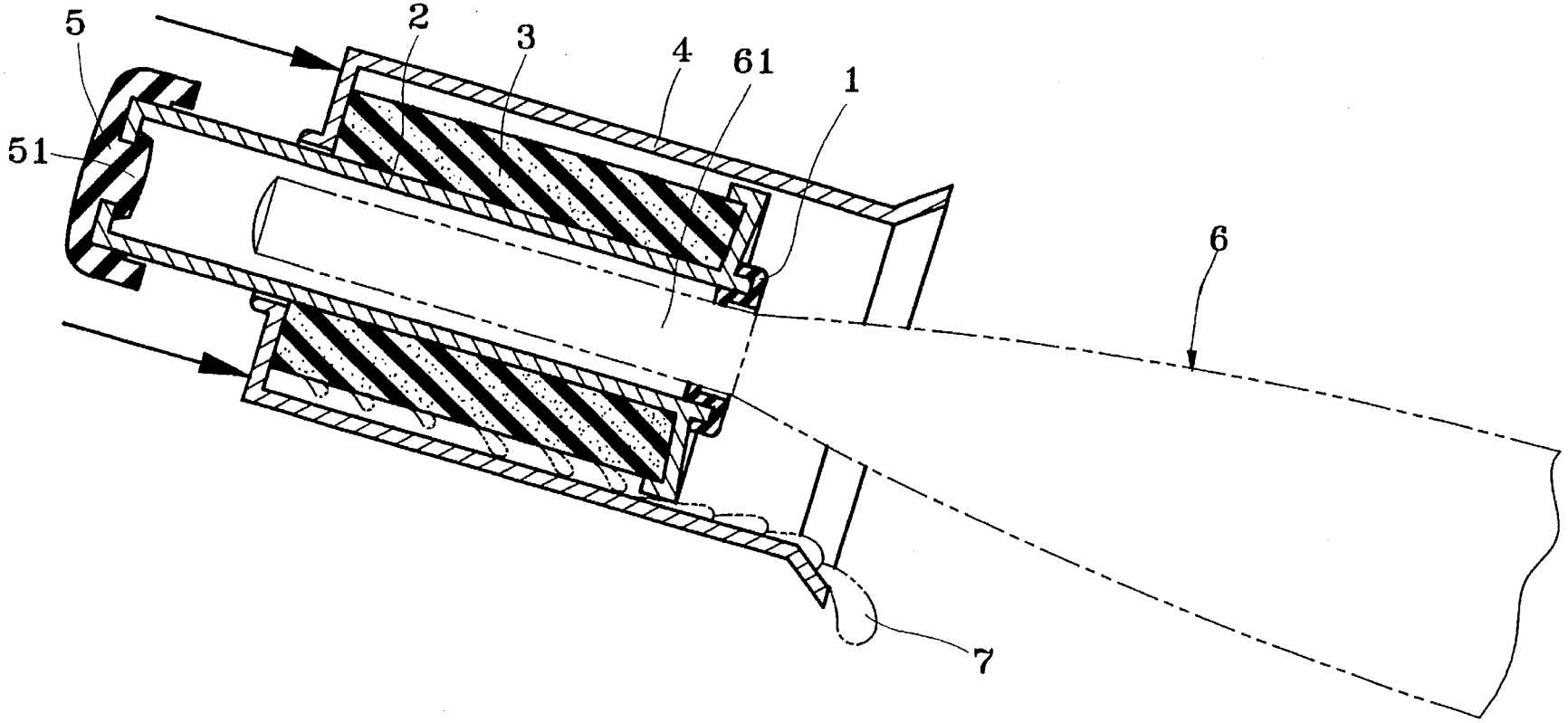
FIG. 5 shows the receptacle moved relative to the barrel and water squeezed out of the sponge according to the present invention.

Referring to FIG. 5, when the receptacle 4 is moved relative to the barrel 2 towards the umbrella 6, the sponge 3 is compressed by the outward flange 21 of the barrel 2, and therefore water 7 is squeezed out of the sponge 3 and then guided out of the receptacle 4. When the receptacle 4 is released from the hand, the sponge 3 immediately returns to its former shape to force the outward flange 21 of the barrel 2 back to its former position, and therefore the bottom rubber cap 5 is moved back to its former position and stopped around the bottom hole 41 outside the receptacle 4.

It is to be understood that the drawings are designed for purposes illustration only, and are not intended as a definition of the limits and scope of the invention disclosed.

I claim:

1. An umbrella drip water collector for attaching to the ferrule of an umbrella to collect drip water, comprising:

a receptacle having an open top side, a closed bottom side, and a bottom hole at the center of said closed bottom side, the diameter of said top open side gradually increasing toward the outside;

a sponge mounted inside said receptacle and having a longitudinal center through hole aligned with the bottom hole on said receptacle;

a hollow barrel inserted into the longitudinal center through hole, said barrel comprising an outward flange at a top end thereof covered on said sponge inside said receptacle, a bottom hole at the center of a bottom end thereof disposed outside the bottom hole of said receptacle, said outward flange having a plurality of radial slots for guiding water to said sponge inside said receptacle;

a top rubber cap fastened to said barrel and stopped above said outward flange, defining a stepped center through hole for permitting the ferrule of the umbrella to be inserted into the inside of said barrel; and a bottom rubber cap fastened to said barrel and stopped outside said receptacle to seal the bottom hole of said receptacle, having a headed inside stud fastened to the bottom hole of said barrel;

wherein when said receptacle is moved axially relative to said barrel, water is squeezed out of said sponge by said outward flange of said barrel.

* * * * *